United States Patent [19]

Ferguson

[11] Patent Number: 4,768,580

[45] Date of Patent: Sep. 6, 1988

[54] MARINE PROPULSION DEVICE OIL COOLING ARRANGEMENT

[75] Inventor: Arthur R. Ferguson, Northbrook, Ill.

[73] Assignee: Outboard Marine Corporation, Waukegan, Ill.

[21] Appl. No.: 139,169

[22] Filed: Dec. 21, 1987

Related U.S. Application Data

[60] Continuation of Ser. No. 931,528, Feb. 9, 1987, abandoned, which is a division of Ser. No. 779,273, Sep. 23, 1985, Pat. No. 4,641,615.

[51] Int. Cl.[4] ..... F28D 1/04; F28D 1/06

[52] U.S. Cl. ..... 165/41; 165/74; 165/132; 165/161; 165/916; 165/51

[58] Field of Search ..... 165/41, 51, 73, 74, 165/75, 119, 132, 158, 159, 160, 161, 916

[56] References Cited

U.S. PATENT DOCUMENTS

| | | | |
|---|---|---|---|
| 1,723,082 | 8/1929 | Schumann | 165/132 |
| 2,014,028 | 9/1935 | Palmer | 165/51 |
| 3,933,576 | 1/1976 | Rushton | 165/74 |

FOREIGN PATENT DOCUMENTS

| | | | |
|---|---|---|---|
| 624816 | 1/1936 | Fed. Rep. of Germany | 165/74 |
| 0122060 | 10/1978 | Japan | 165/51 |
| 0120190 | 6/1985 | Japan | 165/159 |
| 1095862 | 12/1967 | United Kingdom . | |
| 1235228 | 6/1971 | United Kingdom | 165/132 |

*Primary Examiner*—Albert W Davis, Jr.
*Assistant Examiner*—John K Ford
*Attorney, Agent, or Firm*—Michael, Best & Friedrich

[57] ABSTRACT

A marine propulsion device comprising a propulsion unit adapted to be mounted on the transom of a boat for pivotal movement relative to the transom about a generally vertical steering axis, and about a generally horizontal tilt axis, the propulsion unit including a rotatably mounted propeller, an engine drivingly connected to the propeller, and a wall at least partially defining a cooling water jacket and having therein an opening communicating with the water jacket, and a fluid cooler extending through the opening and including a portion extending internally of the water jacket and having therein a fluid passage adapted to communicate with a source of fluid to be cooled in the fluid cooler.

2 Claims, 1 Drawing Sheet

MARINE PROPULSION DEVICE OIL COOLING ARRANGEMENT

RELATED APPLICATION

This application is a continuation of application Ser. No. 931,528, Feb. 9, 1987, abandoned which is a division of application Ser. No. 779,273, filed Sept. 23, 1985 now U.S. Pat. No. 4,641,615.

BACKGROUND OF THE INVENTION

The invention relates to oil cooling arrangements, and more particularly to hydraulic oil cooling arrangements in marine propulsion devices.

As disclosed in Taylor U.S. Pat. No. 2,637,173, it is known to insert a cartridge into an engine water jacket in order to heat liquid fuel in the cartridge. It is also known to insert a heat sink for electrical components into an engine water jacket in order to cool the electrical components.

As disclosed in Ritzenthaler U.S. Pat. No. 4,167,969, it is also known to insert a transmission oil cooler into a hose of an engine cooling system.

It is also known to use a water jacket for cooling a lubricating oil pump, as disclosed in Tado U.S. Pat. Nos. 3,493,081 and 3,380,443, and to exteriorly add a heat exchanger to an engine with the heat exchanger being connected to the engine water jacket, as disclosed in McKinney U.S. Pat. No. 2,898,896.

| Attention is also directed to the following U.S. Pat. No.: | | |
|---|---|---|
| Schutt | 2,212,250 | August 20, 1940 |
| Dalin | 2,888,251 | May 26, 1959 |
| Gearn | 3,234,884 | February 15, 1966 |
| Miersch | 3,990,424 | November 9, 1976 |
| Veach | 4,442,819 | April 17, 1984 |
| Hofmeister | 2,660,410 | November 24, 1953 |

SUMMARY OF THE INVENTION

The invention provides a marine propulsion device comprising a propulsion unit adapted to be mounted on the transom of a boat for pivotal movement relative to the transom about a generally vertical steering axis, and about a generally horizontal tilt axis, the propulsion unit including a rotatably mounted propeller, and an engine drivingly connected to the propeller and including a cooling water jacket, and a fluid cooler including a portion located internally of the water jacket and having therein a fluid passage adapted to communicate with a source of fluid to be cooled in the fluid cooler.

In one embodiment, the fluid cooler further includes a water passage communicating with the water jacket and located adjacent the fluid passage such that the water in the water passage cools the fluid in the fluid passage.

In one embodiment, the fluid cooler further includes a water inlet and a water outlet both communicating with the water jacket, and a fluid inlet and a fluid outlet both extending externally of the water jacket and both being adapted to communicate with the source of fluid, the water passage communicates between the water inlet and the water outlet, and the fluid passage communicates between the fluid inlet and the fluid outlet.

In one embodiment, the water in the water jacket flows in one direction in the area adjacent the fluid cooler, and the water outlet is spaced from the water inlet in the one direction.

In one embodiment, the fluid cooler further includes a first end extending internally of the water jacket, and an opposite second end, the water inlet is located adjacent the second end and internally of the water jacket, and the water outlet is located adjacent the first end.

In one embodiment, the fluid cooler further includes a generally cylindrical outer wall, and a first end wall defining the first end, the water inlet is located in the outer wall, and the water outlet is located in the first end wall.

In one embodiment, the water passage includes a water chamber communicating with the water inlet, and a water tube extending from the water chamber through the first end wall and defining the water outlet.

In one embodiment, the outer wall defines a generally cylindrical inner chamber, the fluid cooler further includes a dividing wall located intermediate the first and second ends and dividing the inner chamber into a fluid chamber adjacent the first end and a water chamber adjacent the second end and in communication with the water inlet, a water tube extending through the fluid chamber and having a first end extending through the first end wall and defining the water outlet, and an opposite second end extending through the dividing wall and communicating with the water chamber, a fluid supply tube communicating between the fluid chamber and the fluid inlet, and a fluid return tube communicating between the fluid chamber and the fluid outlet, the water passage includes the water chamber and the water tube, and the fluid passage includes the fluid chamber, the fluid supply tube, and the fluid return tube.

The invention also provides a marine propulsion device comprising a propulsion unit including a rotatably mounted propeller, and an engine drivingly connected to the propeller and including a wall at least partially defining a cooling water jacket and having therein an opening communicating with the water jacket, and a fluid cooler extending through the opening and including a first portion extending internally of the water jacket and having therein a water inlet and a water outlet both communicating with the water jacket, a second portion extending externally of the water jacket and having therein a fluid inlet and a fluid outlet both adapted to communicate with a source of fluid to be cooled in the fluid cooler, a water passage communicating between the water inlet and the water outlet, and a fluid passage communicating between the fluid inlet and the fluid outlet.

In one embodiment, the engine includes a pair of spaced apart cylinder banks, and the water jacket is located between the banks and has an upper end defined by the wall.

The invention also provides a marine propulsion device comprising a propulsion unit adapted to be mounted on the transom of a boat for pivotal movement relative to the transom about a generally vertical steering axis, and about a generally horizontal tilt axis, the propulsion unit including a rotatably mounted propeller, and an engine drivingly connected to the propeller and including a wall at least partially defining a cooling water jacket and having therein an opening communicating with the water jacket. The device also comprises a hydraulic circuit including a source of hydraulic oil, and a hydraulic oil cooler extending through the opening in the wall and having a first end extending internally of the water jacket, and a second end extending externally of the water jacket, the oil cooler including a generally cylindrical outer wall defining a generally cylindrical inner chamber and having therein a plurality of water inlets adjacent the second end and in communication with the water jacket, a first end wall defining the first end, a second end wall defining the second end, a dividing wall located intermediate the first and second end walls and dividing the inner chamber into an oil chamber adjacent the first end, and a water chamber adjacent the second end and in communication with the water inlet, a plurality of water tubes extending through the oil chamber and having respective first ends extending through the first end wall and defining respective water outlets communicating with the water jacket, and respective opposite second ends extending through the dividing wall and communicating with the water chamber, an oil supply tube extending through the water chamber and having a first end extending through the dividing wall and communicating with the oil chamber, and an opposite second end extending through the second end wall and defining an oil inlet, an oil return tube extending through the water chamber and having a first end extending through the dividing wall and communicating with the oil chamber, and a second end extending through the second end wall and defining an oil inlet, one of the oil supply tube and the oil return tube extending adjacent the first end, and a plurality of baffles located in the oil chamber for causing oil therein to flow along a circuitous path.

A principal feature of the invention is the provision of a marine propulsion device comprising a hydraulic fluid cooler located in an engine water jacket. This provides an effective method of cooling hydraulic fluid while using an existing source of cooling water. Because the fluid cooler is located in the water jacket, no additional space is required for the combined engine and fluid cooler. Furthermore, because the fluid cooler is located near the source of hydraulic fluid, shorter hydraulic conduits can be used and less pumping of hydraulic fluid is required.

Another principal feature of the invention is the provision of a marine propulsion device comprising a fluid cooler extending through an opening in an engine water jacket wall. This provides an efficient method of cooling hydraulic fluid.

Another principal feature of the invention is the provision of such an arrangement including the above-described fluid cooler.

Other principal features and advantages of the invention will become apparent to those skilled in the art upon review of the following detailed description, claims, and drawings.

Figure 1:
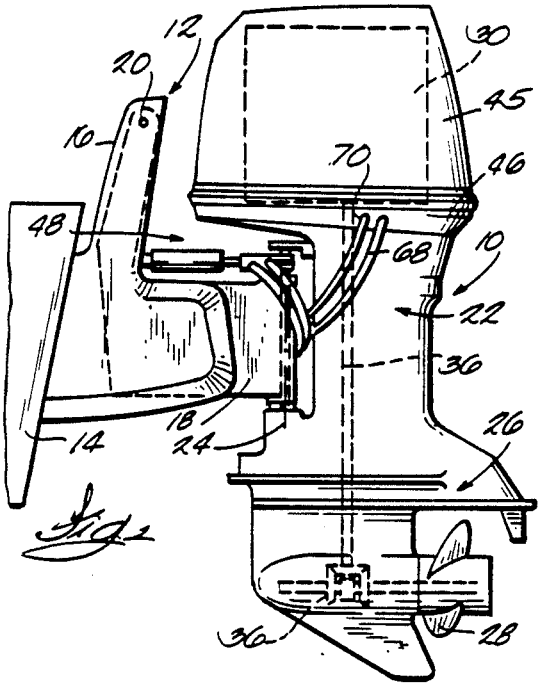
FIG. 1 is a side elevational view of a marine propulsion device embodying the invention.

Before one embodiment of the invention is explained in detail, it is to be understood that the invention is not limited in its application to the details of construction and the arrangements of components set forth in the following description or illustrated in the drawings. The invention is capable of other embodiments and of being practiced or being carried out in various ways. Also, it is to be understood that the phraseology and terminology used herein is for the purpose of description and should not be regarded as limiting.

DESCRIPTION OF THE PREFERRED EMBODIMENT

A marine propulsion device 10 embodying the invention is illustrated in the drawings. As best shown in FIG. 1, the marine propulsion device 10 comprises a mounting assembly 12 fixedly attached to the transom 14 of a boat. In the preferred embodiment, the mounting assembly 12 includes a transom bracket 16 fixedly attached to the transom 14, and a swivel bracket 18 pivotally mounted on the transom bracket 16 for pivotal movement of the swivel bracket 18 relative to the transom 14 about a generally horizontal tilt axis 20.

Figure 2:
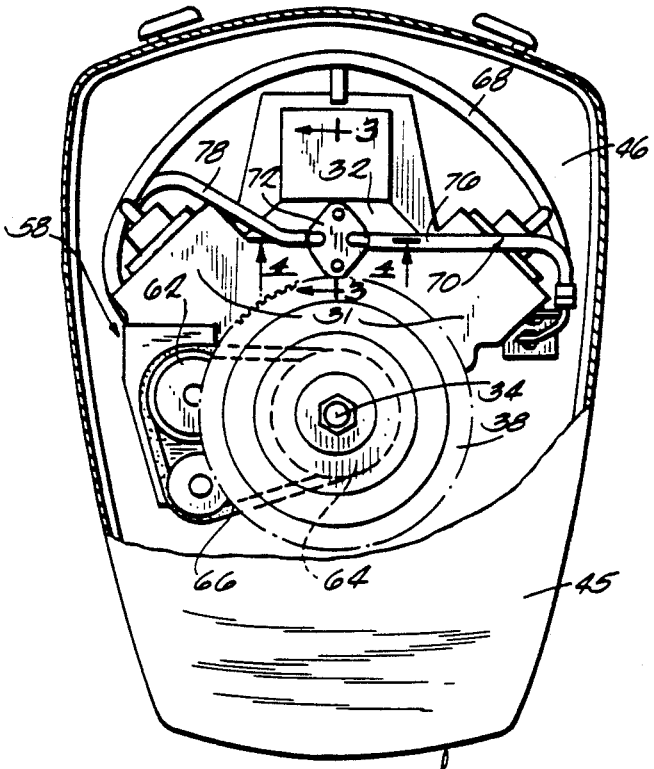
FIG. 2 is a top view of the engine of the marine propulsion device.
Figure 3:
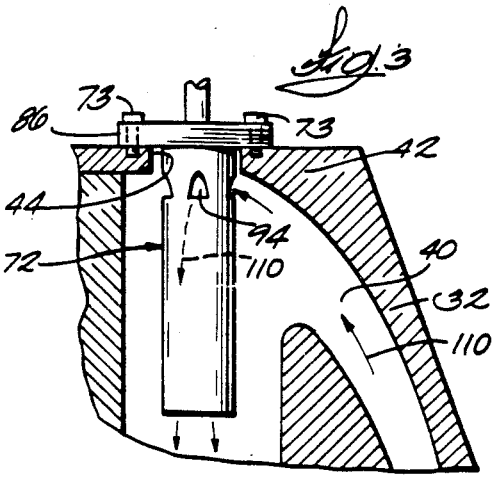
FIG. 3 is a vertical, cross-sectional view taken along line 3—3 in FIG. 2

The marine propulsion device 10 also comprises a propulsion unit 22 pivotally mounted on the swivel bracket 18 for pivotal movement of the propulsion unit 22 relative to the swivel bracket 18 about a generally vertical steering axis 24. The propulsion unit 22 includes a lower unit 26 including a rotatably mounted propeller 28, and an internal combustion engine 30 mounted on the lower unit 26. In the preferred embodiment, the engine 30 includes a pair of cylinder banks 31 and an engine block 32 (shown in outline in FIG. 2), and a generally vertical crankshaft 34 rotatably supported by the engine block 32 and having an upper end extending upwardly from the engine block 32, and a lower end drivingly connected to the propeller 28 by a drive train 36. The engine 30 also includes a flywheel 38 mounted on the upper end of the crankshaft 34, and a cooling water jacket 40 (FIG. 3) defined by the engine block 32. As best shown in FIG. 3, in the preferred embodiment, the water jacket 40 is located between the cylinder banks 31 of the engine 30 and is partially defined by an upper wall 42 having an opening 44 therein.

The marine propulsion device 10 further comprises a housing surrounding the engine 30 and including upper and lower covers 45 and 46, respectively.

The marine propulsion device 10 further comprises a hydraulic power steering system 48 connected between the propulsion unit 22 and the swivel bracket 18 for causing pivotal steering movement of the propulsion unit 22 about the steering axis 24. Any suitable power steering system can be employed. An example of a suitable power steering system is described in Ferguson U.S. patent application Ser. No.614,815, filed May 29, 1984, which is incorporated herein by reference.

The marine propulsion device 10 further comprises a hydraulic circuit communicating with the power steering system 48 for providing thereto hydraulic oil or fluid. In the preferred embodiment, the hydraulic circuit includes a source of hydraulic oil, preferably a conventional pump assembly 58 (FIG. 2) including a reservoir. In the illustrated construction, as best shown in FIG. 2, the pump assembly 58 is mounted on the side of the engine block 32.

The marine propulsion device 10 further comprises means for powering the pump assembly 58. While various suitable powering means can be used, in the preferred embodiment, the pump assembly 58 includes a drive pulley 62, and the powering means includes a power takeoff pulley 64 mounted on the underside of the flywheel 38, and belt means 66 drivingly connecting the power takeoff pulley 64 to the drive pulley 62.

The hydraulic circuit also includes supply conduit means 68 communicating between the pump assembly 58 and the power steering system 48 and return conduit means 70 communicating between the power steering system 48 and the pump assembly 58. In the illustrated construction, as best shown in FIGS. 1 and 2, the supply conduit means 68 extends around the rear of the engine 30 from the pump assembly 58 and through the lower cover 46 on the port side of the engine 30, and then between the propulsion unit 22 and the swivel bracket 18 (see FIG. 1) to the starboard side of the engine 30 where it communicates with the power steering system 48. The return conduit means 70 extends from the power steering system 48 through the lower cover 46 along a path parallel to the path of the supply conduit means 68.

The hydraulic circuit further includes a hydraulic oil or fluid cooler 72 communicating with the return conduit means 70 for cooling the hydraulic oil therein. As best shown in FIG. 3, the fluid cooler 72 extends through the opening 44 in the engine block wall 42 so as to extend downwardly into the water jacket 40 between the cylinder banks 31 and has a first or lower portion including a first or lower end, the lower portion being located internally of or extending internally of the water jacket 40, and a second or upper portion including a second or upper end and extending externally from the water jacket 40 and adjacent the wall 42. Suitable means such as bolts 73 are provided for securing the fluid cooler 72 to the engine block wall 42.

In the preferred embodiment, the return conduit means 70 includes (see FIGS. 2 and 4) a first return conduit 76 communicating between the power steering system 48 and the fluid cooler 72, and a second return conduit 78 communicating between the fluid cooler 72 and the pump assembly 58.

The fluid cooler 72 includes a fluid passage communicating with the first return conduit 76. In the preferred embodiment, the fluid passage includes (see FIG. 4) a fluid or oil supply tube 100 communicating with the first return conduit 76, a fluid or oil return tube 104 communicating with the second return conduit 78, and a fluid or oil chamber 90. Preferably, the fluid cooler 72 further includes a water passage located adjacent the fluid passage such that the water in the water passage cools the fluid in the fluid passage. In the preferred embodiment, the water passage includes a water chamber 92 and a plurality of water tubes 96.

Figure 4:
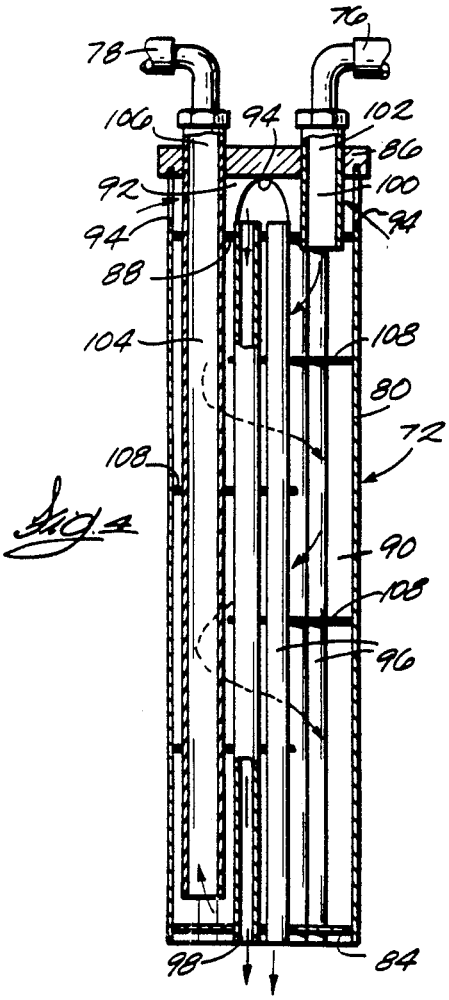
FIG. 4 is a cross-sectional view taken along line 4—4 in FIG. 2.
Figure 5:
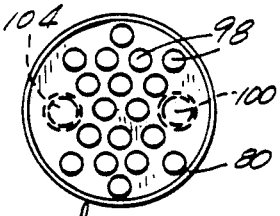
FIG. 5 is a bottom view of the fluid cooler.

In the preferred embodiment, as best shown in FIG. 4, the fluid cooler 72 also includes a generally cylindrical outer wall 80 defining a generally cylindrical inner chamber, a first or lower end wall 84 defining the first or lower end of the fluid cooler 72, and a second or upper end wall 86 defining the second or upper end of the fluid cooler 72. Preferably, the outer wall 80 has a diameter less than the diameter of the opening 44 to permit insertion of the fluid cooler 72 into the opening 44. The fluid cooler 72 also includes a dividing wall 88 located intermediate the first and second end walls 84 and 86 and dividing the inner chamber into the fluid chamber 90 which is located adjacent the lower end of the fluid cooler 72, and the water chamber 92 which is located adjacent the upper end of the fluid cooler 72. The fluid cooler 72 further includes a plurality of water inlets 94 (see FIGS. 3 and 4) located in the outer wall 80 adjacent the upper end of the fluid cooler 72 and communicating between the water jacket 40 and the water chamber 92.

As best shown in FIG. 4, the water tubes 96 extend through the fluid chamber 90 and have respective first or lower ends extending through the lower end wall 84 and defining respective water outlets 98 communicating with the water jacket 40, and respective opposite second or upper ends extending through the dividing wall 88 and communicating with the water chamber 92.

The fluid supply tube 100 extends through the water chamber 92 and has a first or lower end extending through the dividing wall 88 and communicating with the fluid chamber 90, and an opposite second or upper end extending through the upper end wall 86 and defining an oil inlet 102. The fluid return tube 104 extends through the water chamber 92 and has a first or lower end extending through the dividing wall 88 and communicating with the fluid chamber 90, and a second or upper end extending through the second end wall 86 and defining an oil outlet 106. In the preferred embodiment, the fluid supply tube 100 extends just beyond the dividing wall 88 into the upper portion of the fluid chamber 90, and the fluid return tube 104 extends adjacent the first or lower end of the fluid cooler 72. Thus, fluid entering the fluid chamber 90 through the fluid supply tube 100 must flow downwardly through the fluid chamber 90 to exit through the fluid return tube 104.

In the preferred embodiment, the fluid cooler 72 further includes (see FIG. 4) a plurality of baffles 108 located in the fluid chamber 90 for causing the oil therein to flow along a circuitous path. In the illustrated construction, the baffles 108 extend inwardly from alternate sides of the fluid chamber 90, and the water tubes 96 extend through the baffles 108. Accordingly, the fluid is caused to flow back and forth across the water tubes 96 while flowing downwardly through the fluid chamber 90.

In the preferred embodiment, the water in the water jacket 40 flows in the direction shown by the arrows 110 in FIG. 3. In the area adjacent the fluid cooler 72, the water in the water jacket 40 flows downwardly. Because the water outlets 98 are spaced downwardly from the water inlets 94, the water flow through the cooling jacket 40 causes downward water flow through the water tubes 96 of the fluid cooler 72.

It should be understood that the fluid passage can in alternative embodiments have any suitable construction enabling cooling of the fluid in the fluid passage by the water in the water jacket 40. For instance, the fluid passage can be the entire interior of the fluid cooler 72.

Various features and advantages of the invention are set forth in the following claims.

I claim:

1. A hydraulic oil cooler comprising a generally cylindrical outer wall defining a generally cylindrical inner chamber and having therein a plurality of water inlets adapted to communicate with a source of water, a first end wall defining a first end, a second end wall defining a second end, a dividing wall located intermediate said first and second end walls and dividing said inner chamber into an oil chamber adjacent said first end, and a water chamber adjacent said second end and in communication with said water inlets, a plurality of water tubes extending through said oil chamber and having respective first ends extending through said first end wall and defining respective water outlets, and respective opposite second ends extending through said dividing wall and communicating with said water chamber, an oil supply tube extending through said water chamber and having a first end extending through said dividing wall and communicating with said oil chamber, and an opposite second end extending through said second end wall and defining an oil inlet, an oil return tube extending through said water chamber and having a first end extending through said dividing wall and communicating with said oil chamber, and a second end extending through said second end wall and defining an oil outlet, one of said oil supply tube and said oil return tube extending adjacent said first end, and a plurality of baffles located in said oil chamber for causing oil therein to flow along a circuitous path.

2. A hydraulic oil cooler comprising an outer wall defining an inner chamber, a first end wall defining a first end, a second end wall defining a second end, a dividing wall located intermediate said first and second end walls and dividing said inner chamber into an oil chamber adjacent said first end, and a water chamber adjacent said second end, a water inlet in said outer wall communicating with said water chamber and adapted to communicate with a source of water, a water tube extending through said oil chamber and having a first end extending through said first end wall and defining a water outlet and an opposite second end extending through said dividing wall and communicating with said water chamber, an oil supply tube extending through said water chamber and having a first end extending through said dividing wall and communicating with said oil chamber, and an opposite second end extending through said second end wall and defining an oil inlet, an oil return tube extending through said water chamber and having a first end extending through said dividing wall and communicating with said oil supply chamber, and a second end extending through said second end wall and defining an oil outlet, one of said oil supply tube and said oil return tube extending adjacent said first end, and a baffle located in said oil chamber for causing oil therein to flow along said circuitous path.

* * * * *